US005802993A

United States Patent [19]

Meador

[11] Patent Number: 5,802,993

[45] Date of Patent: Sep. 8, 1998

[54] PYROLYSIS SYSTEM AND METHOD

[76] Inventor: W. R. Meador, 1031 Andrews Hwy. Suite 310, Midland, Tex. 79701

[21] Appl. No.: 742,083

[22] Filed: Oct. 31, 1996

[51] Int. Cl.[6] ..... F23J 11/00; F23G 5/12; F27B 9/02

[52] U.S. Cl. ..... 110/345; 110/203; 110/229; 110/235; 110/346; 432/128; 49/68

[58] Field of Search ..... 110/229, 235, 110/242, 246, 203, 215, 216, 345, 346; 432/128, 133, 135, 136, 137, 138; 49/50, 52, 54, 56, 68, 70, 197, 377, 483.1, 472, 507

[56] References Cited

U.S. PATENT DOCUMENTS

| | | | |
|---|---|---|---|
| 1,086,278 | 2/1914 | Cowles | 432/137 |
| 3,410,547 | 11/1968 | Bielefeldt | 49/68 |
| 3,982,887 | 9/1976 | Kendziora et al. | 432/128 |
| 4,421,481 | 12/1983 | Holz et al. | 432/239 |
| 4,573,909 | 3/1986 | Scanlon | 432/133 |
| 4,586,898 | 5/1986 | Orbeck | 432/122 |
| 4,648,328 | 3/1987 | Keough | 110/229 |
| 4,773,851 | 9/1988 | Mueller | 432/48 |
| 4,886,449 | 12/1989 | Brittin | 432/121 |
| 4,932,864 | 6/1990 | Miyabe | 432/128 |
| 5,044,944 | 9/1991 | Furuya et al. | 432/128 |
| 5,078,594 | 1/1992 | Tutt et al. | 432/103 |
| 5,117,564 | 6/1992 | Taguchi et al. | 34/92 |
| 5,437,237 | 8/1995 | Digre | 110/346 |
| 5,443,383 | 8/1995 | Kuehn | 432/122 |
| 5,586,855 | 12/1996 | Eshleman | 414/160 |
| 5,624,255 | 4/1997 | Hisada et al. | 432/128 |
| 5,678,496 | 10/1997 | Buizza et al. | 110/229 |

FOREIGN PATENT DOCUMENTS

| | | | |
|---|---|---|---|
| 1451107 A1 | 1/1989 | U.S.S.R. | 432/137 |

*Primary Examiner*—Ira S. Lazarus
*Assistant Examiner*—Ljiljana V. Ciric

[57] ABSTRACT

Pyrolysis system and method wherein used batteries other than lead-acid batteries for reclamation and recovery of the constituents therein or environmentally safe disposal are placed in rail carts and moved on rails through an entry zone into a central heating zone of a pyrolysis chamber maintained under a negative pressure and then into an exit zone. A series of rail carts containing the batteries are sequentially transferred, one rail cart at a time, into the entry zone where the pressure is equalized with the central heating zone and the rail cart is transferred into the central heating zone, then the entry zone is returned to atmospheric pressure and another rail cart is moved into the entry zone and the procedure continued until the central heating zone is filled to capacity with rail carts containing the batteries, thereafter the entry zone and exit zone are equalized with the pressure in the central heating zone and a rail cart is transferred from the central heating zone to the exit zone while another rail cart is transferred into the central heating zone. Next the pressure in the entry zone and the exit zone are returned to atmospheric pressure and a rail cart is moved into the entry zone while the rail cart in the exit zone is moved out of the exit zone. The pyrolysis chamber is maintained under a negative pressure to recover the volatilized constituents of the batteries, while the solid constituents of the batteries after pyrolysis remain in the rail carts and are transferred to other processing.

10 Claims, 4 Drawing Sheets

PYROLYSIS SYSTEM AND METHOD

BACKGROUND OF THE INVENTION

This invention relates to a method and system for pyrolyzing batteries and more particularly batteries other than lead-acid batteries and more particularly to reclamation and environmentally safe disposal of nickel cadmium, lithium, carbon-zinc, mercury, alkaline, metal hydride, etc., batteries.

Various pyrolysis chambers have been described for pyrolysis of non-lead acid batteries and recovering the various constituents thereof.

Currently, there is considerable concern with the disposal of used batteries in industrial countries occasioned by the accumulation of batteries from those used in wrist watches to those used in diesel locomotives. Also, even with the increased use of rechargeable batteries, disposal still persists as a problem in many industrial countries.

Various processes have been proposed utilizing pyrolysis for reclaiming rubber tires, plastics, inorganic compounds and metals, such as, cadmium, lithium, mercury, etc. Processes dealing with the treatment of used rubber tires by pyrolysis to recover liquid and gaseous hydrocarbons and separate these from solid residue proliferate as described in various patents. Likewise, a number of pyrolysis processes are described for reclaiming waste metals containing coatings of organic insulation. Further, a number of processes have been proposed for recovery of metals used in various batteries.

U.S. Pat. No. 5,085,738, issued to Harris et al. discloses a method of treating and recovery of organic waste material in an oxygen-free chamber filled with molten lead which is inclined to allow organic material with a lessor specific gravity than the lead to migrate through the molten lead to a higher portion of the chamber. The organic material from the chamber is recycled as fuel gas and the residual solids flow to a reservoir connected to the chamber. Carbon black is drawn into a receiver by a vacuum line located near the top of the reservoir and all the other residual solids flow over a reservoir wall.

A number of processes that are similar to those disclosed in U.S. Pat. No. 3,448,509, issued to O'Reilly, disclose a process wherein a quantity of plastic-insulated wire is placed in a sealed air-tight chamber with limited air therein. The wire is heated in the chamber to a temperature to reduce the plastic to a crisp residue and to evolve gases from the plastic. The off-gases are then wet-scrubbed to remove undesired constituents and the crisp residue is ultimately removed from the wire.

U.S. Pat. No. 3,945,890, issued to Kemp discloses a process for decomposing organic and pseudo-organic materials into useable and reusable forms. Inorganic metals and salts are treated in the same convertor system. The materials are carried on a conveyor through a controlled atmospheric chamber virtually free of oxidizing agents. A negative pressure is maintained upstream of the chamber to collect liquid and gaseous vapor streams which are processed through successive stages of collection containers, condensers and gas scrubbers.

A number of processes describe the method or process of treating batteries to recover useful products. Such a process is described in U.S. Pat. No. 4,775,107, issued to Heng et al. which discloses a process of crushing and then roasting batteries at a temperature of 500° to 1000° C. in an oxidizing atmosphere with volatilized mercury recovered from the off-gas. The roasted material is separated by sieving and magnetic separation which separates iron-containing scrap, and the residue containing magnesium, zinc and silver. Heng et al cites several processes for treating batteries.

U.S. Pat. No. 5,199,975 issued to Gunjishima et al. discloses a method for recovering cadmium in used nickel cadmium batteries by heat treatment. The process discloses the purity of high cadmium by volatilizing cadmium in a non-oxidizing atmosphere.

U.S. Pat. No. 5,252,189 issued to Celi discloses a thermal mechanical treatment in a closed container at a temperature at which, with the assistance of mechanical pressure metal-plastic and metal-metal bonds are disrupted. Synthetic plastic parts and graphite electrodes are separated by physical methods, vaporized mercury is extracted and washed with sulphuric acid. A gas washing device for inert gas leaving the container employs sulphuric acid in which the vaporized mercury reacts forming mercury sulphate.

U.S. Pat. No. 694,519, issued to Baker teaches conveyor apparatus for use in cooling, heating and drying. Articles are introduced and withdrawn from a chamber without exposing the interior of the chamber to the atmosphere. The chamber has a charging-mouth through which receptacles that exactly fit and completely close the mouth as they pass through. The mouths of the chamber are open at the top and bottom and adapted to receive and support the articles to be received in the chamber. The receptacles are then lowered and discharge from the chamber through the discharging mouth.

U.S. Pat. No. 3,071,356, issued to Duffy shows a heat treating furnace. The furnace terminates in rectangular sleeve portions flanged at their outer ends. Conveyor driven rollers mounted in the lower part of the furnace carry open top supports for the material being treated. During heat treating the ends of the furnace are closed by closure plates which span the full width and height of the furnace. Housings have conveyor means in the form of driven rollers which align with driven rollers when the housings are secured to the furnace body. The housing are moved transversely of the furnace body by wheels which travel on rails. The housings can be readily moved into and out of registry with the ends of the furnace body for loading and unloading. The housings are adapted to be purged by non-reactive gas to exclude air or other contaminated gas. After purging the closure plates would be opened to remove one support from the furnace and to move another support into the furnace.

U.S. Pat. No. 3,778,221, issued to Bloom teaches the operation of an annealing furnace. The furnace includes a welded gas tight shell lined with varying thicknesses of refractory material defining a plurality of independently controllable heating and cooling zones in which a vacuum is maintained in the entry section and a hydrogen atmosphere in all other sections. The furnaces additionally include vacuum-purged vestibules at both ends to accommodate the entrance and exit of the coils to be annealed from the interior atmosphere of the furnace. Further, the initial heating section of the furnace, instead of the furnace containing hydrogen, is evacuated and separated from the remainder of the hydrogen-filled furnace by a transfer station having sealable doors on either side thereof.

U.S. Pat. No. 4,047,624, issued to Dorenbos teaches a workpiece handling system for vacuum processing. The system includes a loading chamber, a pressure sealable chamber and an unloading chamber. The loading chamber may also be used as an unloading chamber and only one such loading and unloading chamber would be required. In operation the loading chamber would be loaded with a carrier supporting a number of substrates, the loading chamber is closed and evacuated, and then, a gate to the pressure sealable chamber is opened and the carrier with the substrates is loaded into the pressure sealable chamber which acts as a holding chamber for a multiplicity of discrete substrates and then are removed one at a time and fed into a coating apparatus. When the operation is completed the carrier with the discrete substrates is transferred from the pressure sealable chamber and the pressure sealable chamber is closed and the unloading chamber may be opened after it is returned to atmospheric pressure.

U.S. Pat. No. 1,936,815, issued to Wilkinson shows a tubular heat exchanger having a tight joint and a positive anchorage wherein the tube ends in the tube sheet. In the annular space of the recess between tube and sheet are two interfittings rings having conical surfaces such that if forced to move axially towards each other extend outwardly and inwardly in the recess to form a seal. The seal also employs an end washer or sealing member of soft metal or fiber or a combination.

SUMMARY OF THE INVENTION

This invention provides an improved system for reclamation of used batteries, other than lead-acid batteries, and recovery of the metals, and organic and inorganic materials. The process includes pyrolysis at reduced pressure of various kinds and sizes of batteries in an efficient and economical process. The process comprises transferring rail carts loaded with used batteries into an entry air lock or zone, reducing the pressure therein to that in the pyrolysis chamber, then transferring rail carts containing used batteries one at time into the pyrolysis chamber and after pyrolysis transferring the rail carts into an exit air lock or zone which has the pressure therein reduced, equalizing the pressure to atmospheric and removing rail carts containing the residual solid material one at a time from the pyrolysis chamber.

More particularly the invention relates to a system comprising a pyrolysis chamber having a rail system extending therethrough for transferring a series of rail carts from one end to the other. The pyrolysis chamber has an entry air lock for receiving a rail cart and providing a vacuum entry into the pyrolysis chamber and an exit air lock for removing a rail cart from the pyrolysis chamber at atmospheric conditions.

It is another object of the invention to provide a system for reclamation and recovery of battery constituents by pyrolysis. A pyrolysis chamber is provided having an entry air lock or zone and an exit air lock or zone, a central heating zone, a pair of spaced apart rails extending throughout the pyrolysis chamber. A furnace for heating the central heating zone to a temperature for pyrolysis of the batteries. The batteries are transported into the entry air lock where the pressure is reduced and then into the central heating zone of the pyrolysis chamber maintained at the same reduced pressure and after pyrolysis transported to the exit air lock to be returned to atmospheric pressure and then transporting the residual solid battery constituents to other processes for separating the various constituents. The batteries are transported in a series of wheeled or rail carts on spaced apart rails. A transfer system is provided for moving a series of wheeled carts containing batteries into the entry air lock, throughout the heating zone, into the exit air lock, and then out of the exit air lock. The system further includes a recovery system for receiving the wheeled carts from the exit air lock of the pyrolysis chamber for further processing. The system includes a vapor recovery system for maintaining a partial vacuum within the pyrolysis chamber and includes a heat exchanger for cooling vapors exiting the pyrolysis chamber, a liquid/gas separator for recovering liquids condensed from the vapors and a vacuum pump for maintaining a negative pressure within the vapor recovery system.

It is another object of the invention to provide a door or gate assembly for an air lock or zone which includes a passageway having a sealing member around the passageway and a gate for engagement with the sealing member wherein the gate moves a substantial distance before engaging the sealing member.

It is another object of the invention to provide a door or gate assembly including a pair of side walls spaced apart with an open frame therein between, each side wall having a passageway, one passageway having a sealing member secured thereto and the other passageway having a series of spaced apart correlative wedge members therearound, a gate member having a series of spaced apart correlative wedges members for movement within the open frame of the gate assembly wherein the gate moves a substantial part of its travel until the correlative wedge members on the side wall engage correlative wedge members on the gate and translates the gate into engagement with the seal member, thereby sealing the passageway.

DESCRIPTION OF PREFERRED EMBODIMENT

Figure 1:
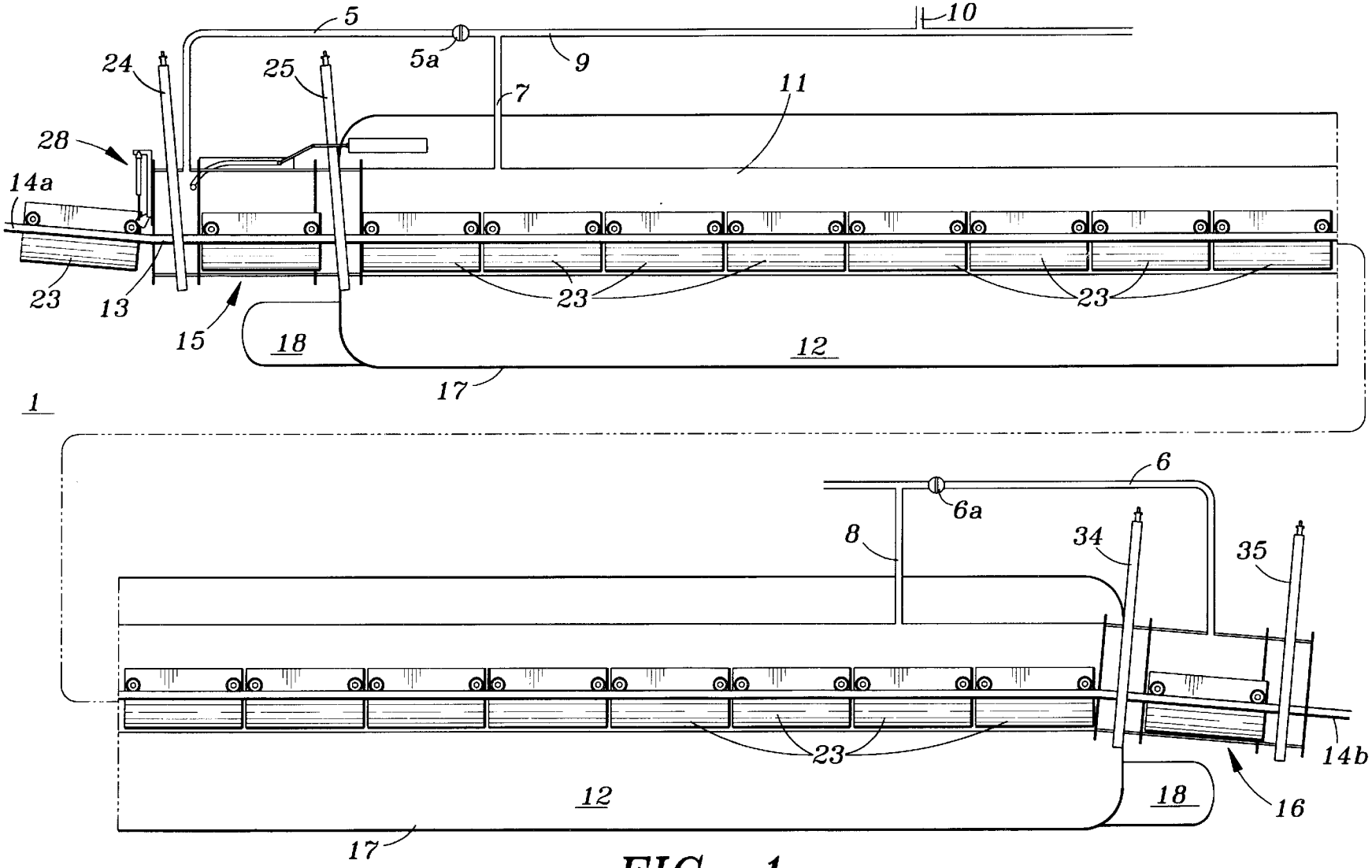
FIG. 1 is a schematic side view of the reclamation apparatus for processing used batteries.

Referring now to FIG. 1, there is illustrated the pyrolysis system, generally referred to as 1, for pyrolyzing non-lead acid batteries. The pyrolysis system consists of a pyrolysis chamber 11, having a heating zone generally referred to as 12, an entry zone or air lock 15 and an exit zone or air lock 16. An outer shell 17, schematically represented, surrounds the heating zone 12. Gas burners 18 are provided at opposite ends of the outer shell 17 to provide a source of heat in the heating zone 12 for pyrolysis to take place. Pyrolysis system 1 has a rail system that includes a pair of rails 13, which extend outside and into entry air lock 15, throughout pyrolysis chamber 11 and exit air lock 16 and beyond. The rail segments 14*a* at the entry air lock 15 are slightly inclined, and rail segments 14*b* in the exit air lock 16 and beyond are slightly declined which permits gravity movement of rail carts 23 into the entry air lock 15 and out of the exit air lock 16.

Pyrolysis chamber 11 has a vacuum line 5 with a valve 5*a* for evacuating entry air lock 15, and a similar vacuum line 6 with a valve 6*a* for evacuating exit air lock 16. Vacuum lines 5 and 6 are connected to main vacuum line 9 by valves 5*a* and 6*a*. A pair of vacuum lines 7 and 8 extend from the heating zone 12 of pyrolysis chamber 11 to the main vacuum line 9 intermediate valves 5*a* and 6*a*. Vacuum line 10 extends from main vacuum line 9 to a vacuum source (not shown) which may be a vapor recovery system.

Figure 2:
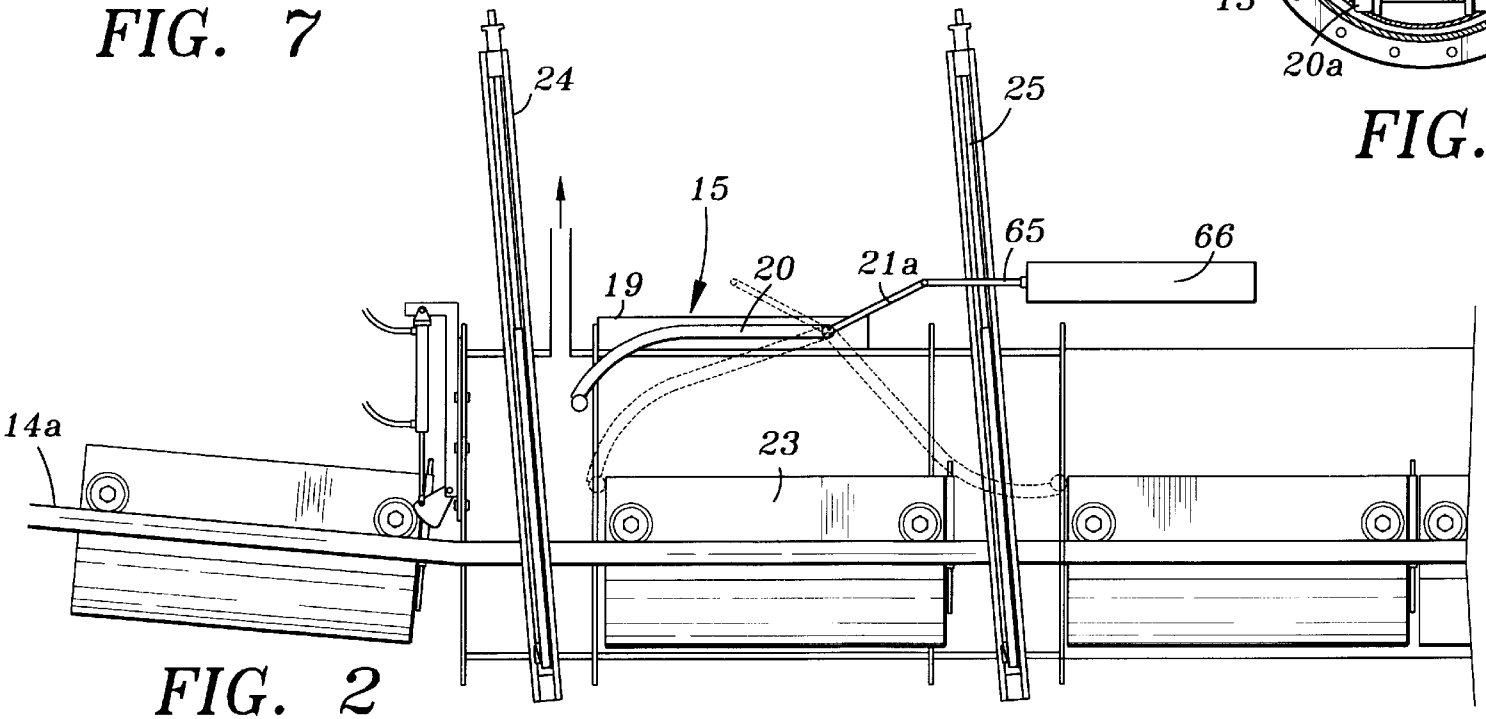
FIG. 2 is a schematic partial side view of the entry air lock in more detail than in FIG. 1.
Figure 3:
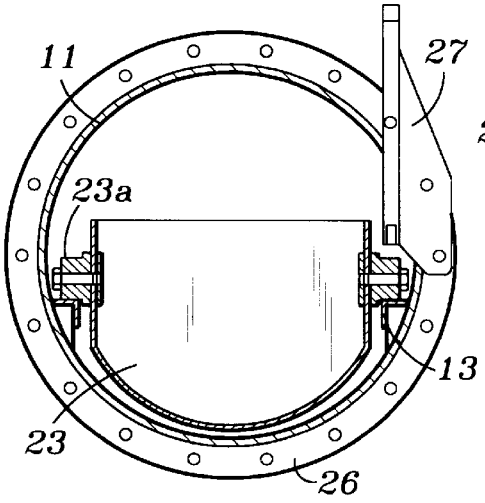
FIG. 3 is a cross sectional view of the pyrolysis chamber with a mounting bracket for supporting the cart release mechanism.
Figure 4:
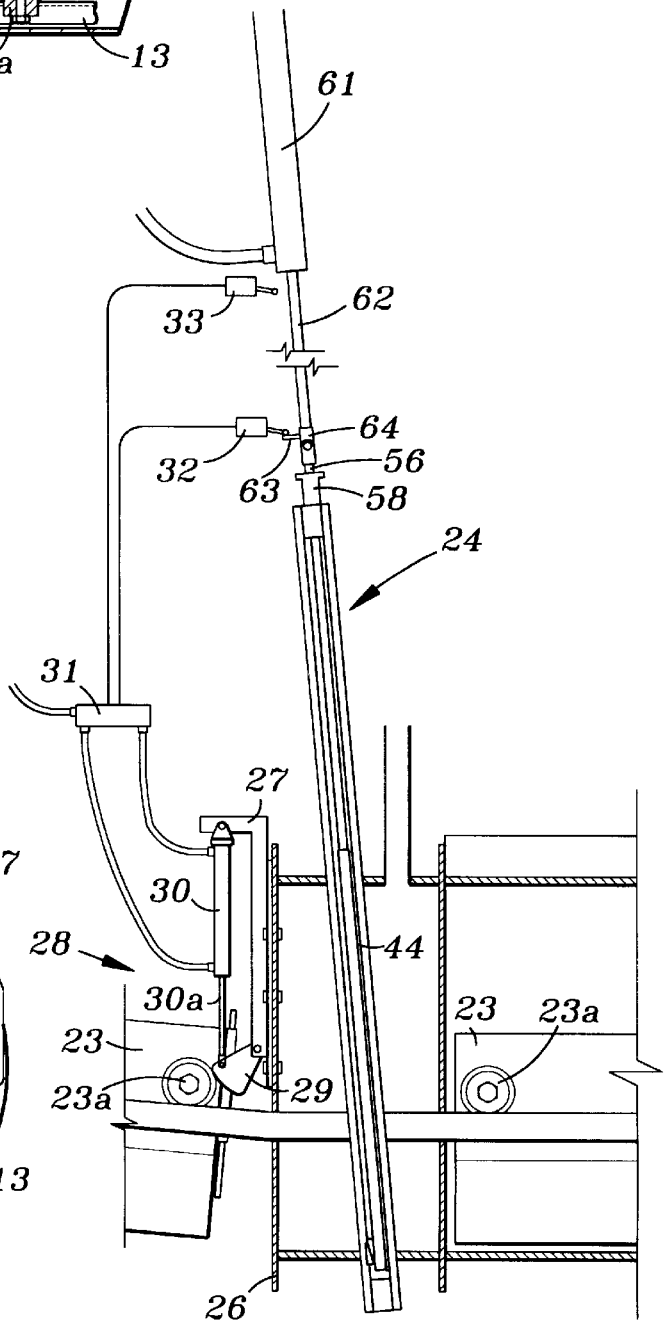
FIG. 4 illustrates, schematically, the operational features of the cart release and gate assembly.
Figure 9:
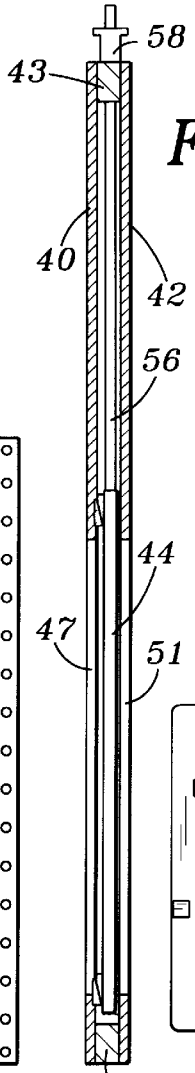
FIG. 9 is the gate assembly illustrating the closed position of the gate.
Figure 13:
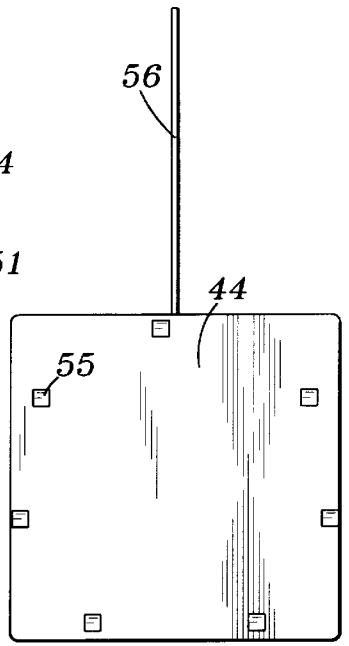
FIG. 13 is a gate with wedges for engagement with the wedge plate of the gate assembly in FIG. 7.
Figure 14:
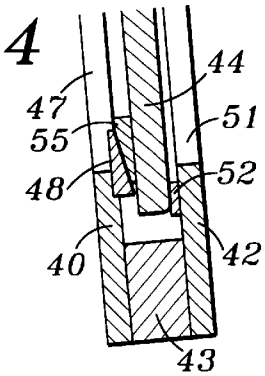
FIG. 14 is a cross sectional view of the lower portion of the gate assembly illustrating the wedges on the wedge plate and on the gate engaged to seal the gate against the seal member of the seal plate.
Figure 11:
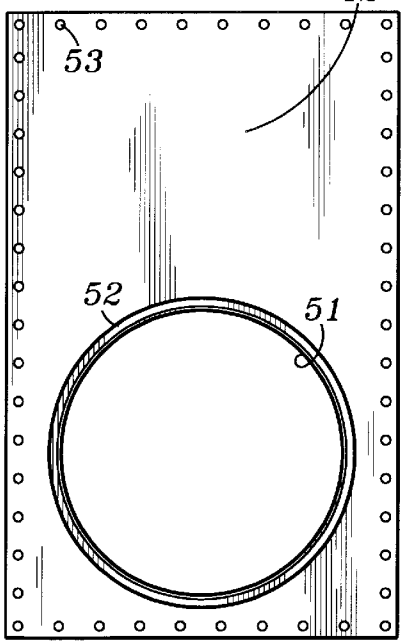
FIG. 11 is a seal plate for the gate assembly illustrated in FIG. 9.

Referring now to FIGS. 1, 2, 3 and 4, the entry air lock 15 has an outer entry gate assembly 24 and an inner entry gate assembly 25. The exit air lock 16 has an inner exit gate assembly 34 and an outer exit gate assembly 35. Pyrolysis chamber 11 has a flange 26 that supports a bracket 27 (as best seen in FIGS. 3 and 4) which supports a cart release mechanism 28. The cart release mechanism 28 includes a wedge 29 pivotally mounted from bracket 27, a hydraulic ram 30 for pivoting wedge 29 which engages a wheel 23*a* of a cart 23. Hydraulic motor 31 activates the ram 30 to pivot wedge 29 to engage or disengage wheel 23*a*. Operating arm 56 of gate assembly 24 is secured to hydraulic ram 61 with piston 62 attached to operating arm 56 for raising and lowering gate 44. Hydraulic motor 31 is activated by limit switch 32 and deactivated by limit switch 33. Limit switch 32 and limit switch 33 are operated by lever arm 63 secured to coupling 64 which joins operating arm 56 to piston 62 of hydraulic ram 61.

Figure 5:
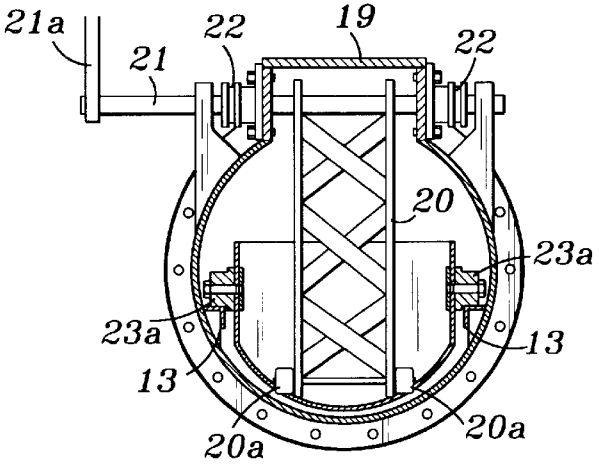
FIG. 5 is a cross sectional view of the pyrolysis chamber illustrating the cart driver engaging a cart to be pushed out of the entry air lock into the heating zone of the pyrolysis chamber.
Figure 6:
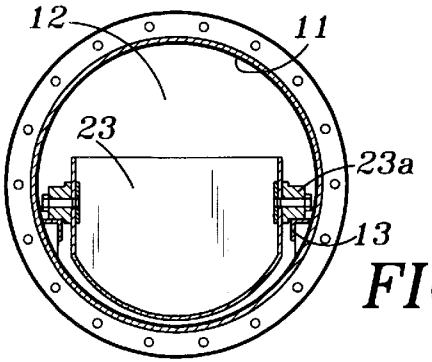
Figure 12:
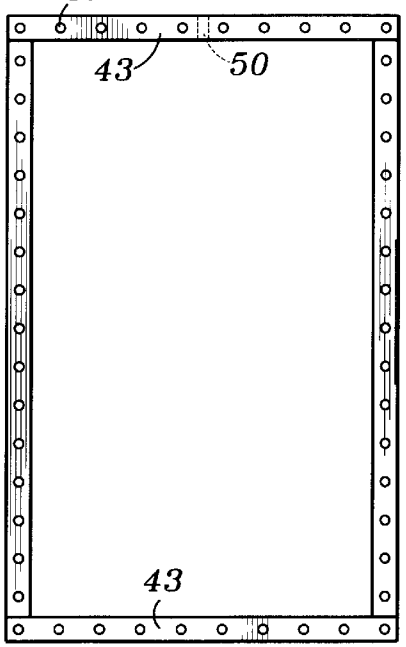
FIG. 12 is a spacer frame for separating the wedge plate and seal plate of the gate assembly in FIG. 9.
Figure 10:
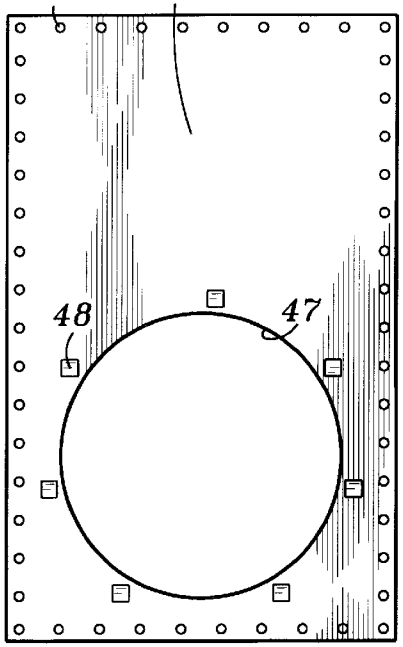
FIG. 10 is a wedge plate with wedges for the gate assembly in FIG. 9.

Referring now to FIGS. 2, 5 and 6, air lock 15 is provided with a housing 19 communicating with the pyrolysis chamber 11 for mounting a cart driver 20 which is secured to an axle 21 journaled in housing 19 by sealed journals 22. Secured to axle 21 external of housing 19 is a crank arm 21*a*. Crank arm 21*a* is secured to piston rod 65 of hydraulic ram 66. A hydraulic pump (not shown) provides the power for operating hydraulic ram 66 to rotate crank arm 21*a*, and thus, cart driver 20. Cart driver 20 has wheels 20*a* which roll against the end of cart 23 to push it through gate assembly 25, when opened, and into the heating zone 12 (see FIG. 6).

Specifically referring now to FIGS. 2 and 5, the operation of cart driver 20 is described. After entry air lock 15 has been evacuated with rail cart 23 therein, gate 44 of gate assembly 25 is opened and cart driver 20 is operated to push rail cart 23 through cart passageways 47 and 51 of gate assembly 25. Hydraulic ram 66 is operated and piston rod 65 rotates crank arm 21*a* and axle 21 which causes cart driver 20 to rotate about journals 22 and wheels 20*a* of cart driver 20 engage the rear of cart 23 and move it through cart passageway 47, open gate 44 and cart passageway 51 and into heating zone 12 of pyrolysis chamber 11.

Figure 8:
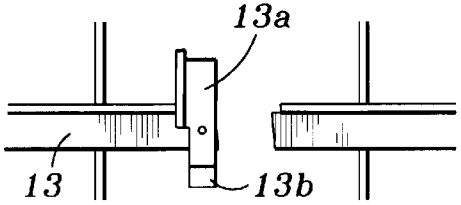
FIG. 8 illustrates the rail bridge open which permits the air lock gate to be closed.
Figure 7A:
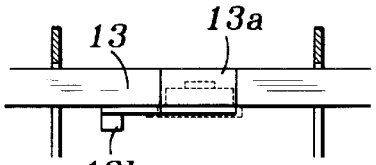
FIG. 7A is a top view of the rail bridge which spans the gap between the rails on either side of the air lock doors when a rail cart wheel is present on the bridge.
Figure 7:
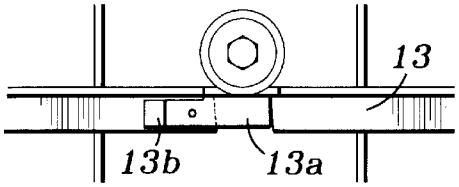
FIG. 7 is a fragmental side view illustrating the rail bridge which spans the gap between the rails on either side of the air lock doors when a rail cart wheel is present on the bridge.
Figure 6A:
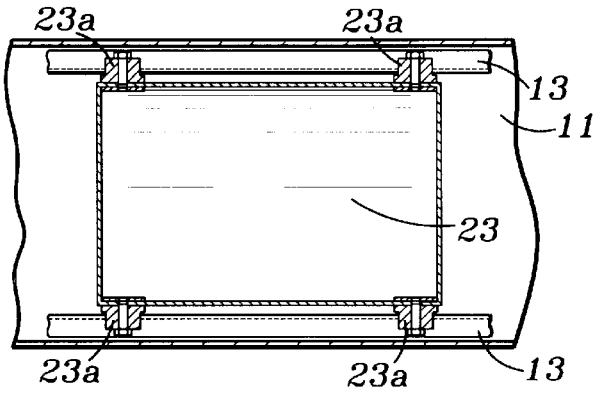
FIG. 6 is a cross sectional view of the heating zone of the pyrolysis chamber with a rail cart therein.

Referring to FIGS. 7, 7A and 8, each rail 13 is provided with a rail bridge 13*a* which has a counterweight 13*b*. The rail bridge 13*a*, when gate 44 of the gate assemblies 24, 25, 34 and 35 are raised, fills the gap between the rails 13 when a rail cart 23 is moved into engagement with rail bridge 13*a* causing it to pivot and provide continuity to rail bridge 13 through cart passageways 47 and 51.

Referring now to FIGS. 9 through 14, gate assemblies 24 and 25 of the entry air lock 15 and gate assemblies 34 and 35 of exit air lock 16 are best illustrated. Each gate assembly includes a wedge plate 40, a seal plate 42, a spacer frame 43 and a door or gate 44. Wedge plate 40 includes a series of peripheral holes 45, a cart passageway 47 and a series of wedge members 48. Spacer frame 43 includes a series of peripheral holes 49 which mate with peripheral holes 45 of wedge plate 40 when assembled and has a bore hole 50. Seal plate 42 has a cart passageway 51 and a seal member 52. Seal plate 42 also has a series of peripheral holes 53 which mate with peripheral holes 49 of spacer frame 43 and peripheral holes 45 of wedge plate 40. Door or gate 44 has a series of wedges 55 correlative with wedges 48 of wedge plate 40 which translate gate 44 in the gate assemblies 24, 25, 34 and 35 into sealing engagement with seal member 52 of seal plate 42. Gate 44 has an operating arm 56 which extends through bore hole 50 and packing gland 58 (see FIG. 9).

Further reference to FIGS. 9 through 14, which illustrate the gate assemblies 24, 25, 34 and 35 and the individual parts, when gate 44 is lowered it does not engage seal member 52 until correlative wedges 55 on gate 44 engages the correlative wedges 48 on wedge plate 40. Gate 44, during its descent before the correlative wedges 48 and wedges 55 engage, travels a substantial distance before it is forced into engagement with seal member 52 effectively sealing the cart passageway 51. With this closure arrangement, gate 44 during a substantial part of its descent, does not engage the seal member 52 until the wedges 48 and wedges 55 engage, and thus, substantially reduces the wear on seal member 52. Consequently, the closing force against the seal exerts more of a compression force than a shear force against the seal member 52.

Referring to the drawings, the operation of the pyrolysis system will be described. With the heating zone 12 of the pyrolysis chamber 11 brought to the pyrolysis temperature with no rail carts 23 present, the initial operation of the furnace begins with a rail cart 23 on the rail segments 14*a* of rails 13, which is loaded with batteries to be processed, is restrained from movement by cart release 28. Upon the opening of gate 44 in outer entry gate assembly 24 piston 62 of hydraulic ram 61 while lifting operating arm 56 permits lever arm 63 to disengage limit switch 32 and engage limit switch 33 activating hydraulic motor 31 causing piston rod 30*a* to pivot wedge 29 away from wheel 23*a* which allows cart 23 to pass through cart passageway 47, open gate 44 on rail bridge 13*a*, through cart passageway 51 and into entry air lock 15 by gravity force. The sequence is repeated about every 10 to 15 minutes until about sixteen rail carts 23 are in the pyrolysis chamber 11 and the entry air lock 15 has a rail cart 23 therein, but the exit air lock 16 does not have a rail cart 23 therein. A cart 23 is moved into heating zone 12 of pyrolysis chamber 11 every ten to fifteen minutes, hence, with the heating zone 12 having a capacity of approximately 16 rail carts 23, from the time a cart 23 is placed into the heating zone 12 from air lock 15, and a rail cart 23 is transferred out of heating zone 12 into exit air lock 16 each rail cart 23 remains in the heating zone 12 for approximately 2½ to 3½ hours. The heating zone 12 is maintained at a temperature between 600° to 800° F. The carts of rail carts 23 may reach temperatures as high as 1100° to 1200° F. The rail carts 23 are made from mild steel with cast iron wheels. Rails 13 and rail segments 14*a* and 14*b* are made of iron. The pyrolysis chamber 11 may be a pipe made of iron or other suitable metal with a nominal diameter of three to four feet. At this point in time the first rail cart 23 to enter the pyrolysis chamber 11 and the batteries contained therein have been pyrolyzed and only the solid residue remains in this first rail cart 23. The next sequence, when gates 44 of inner entry gate assembly 24 opens and gates 44 of inner exit gate assembly 34 opens at the same time while gates 44 of inner exit gate assembly 25 and outer exit gate assembly 35 remain closed. Cart driver 20 is operated upon the raising of gates 44 in the inner entry gate assembly 25 and the inner exit gate assembly 34. Thus, the first rail cart 23 to be pyrolyzed is transferred into the exit air lock 16 and the rail cart 23 in entry air lock 15 is moved into the heating zone 12 of pyrolysis chamber 11. Next, gates 44 of outer entry gate assembly 24, inner entry gate assembly 25, inner exit gate assembly 34 and outer exit gate assembly 35 are closed. Also, another rail cart 23 loaded with batteries for processing is positioned on the rail segments 14*a* of rail 13 restrained by cart release 28. During the next stage of operation, every ten to fifteen minutes, gates 44 of inner entry gate assembly 24 and inner exit gate assembly 34 open, cart driver 20 is activated and pushes another cart 23 into heating zone 12 of pyrolysis chamber 11 so that sequentially each rail cart 23 displaces the next rail cart 23 and finally the last rail cart 23, in heating zone 12 is moved into the exit air lock 16. Gate 44 of inner entry gate assembly 25 closes and at the same time gate 44 of inner exit gate assembly 34 closes. On closing of gate 44 of inner entry gate assembly 25 cart driver 20 is retracted. After a period of ten to fifteen minutes, gates 44 of outer entry gate assembly 24 and outer exit gate assembly 35 open and the rail cart 23 in exit air lock 16 rolls out on the rail segments 14*b* of rails 13. Upon gate 44 of outer entry gate assembly 24 opening, cart release 28 is activated and the rail cart 23 on rail segments 14*a* of rails 13 rolls by gravity force into entry air lock 15 in position under the retracted cart driver 20 after which gates 44 of outer entry gate assembly 24 and outer exit gate assembly 35 are closed. It should be understood that heating zone 12 of pyrolysis chamber 11 is maintained under sub-atmospheric pressure equivalent to a partial vacuum of less than 1" of Hg or 10 feet of water, therefore, when gates 44 of outer entry gate assembly 24 and outer exit gate assembly 35 are closed and gates 44 of inner entry gate assembly 25 and inner exit gate assembly 34 are closed, entry air lock 15 and exit air lock 16 are evacuated to the same sub-atmospheric pressure as heating zone 12 of pyrolysis chamber 11. This is accomplished by opening valves 5*a* and 6*a* in vacuum lines 5 and 6, respectively, which connects the entry air lock 15 and exit air lock 16 through main vacuum line 9 to the vacuum source through vacuum line 10. In order to move rail cart 23 in entry air lock 15 into the heating zone 12, and to remove the last rail cart 23 in the heating zone 12 into exit air lock 16, inner entry gate assembly 25 and inner exit gate assembly 34 are opened, equal sub-atmospheric pressure is maintained in the entry air lock 15 and exit air lock 16, as in the heating zone 12. Likewise, when gates 44 of outer entry gate assembly 24 and outer exit gate assembly 35 are opened, entry air lock 15 and exit air lock 16 are returned to atmospheric pressure while heating zone 12 of pyrolysis chamber 11 remains at sub-atmospheric pressure.

It should be understood that the sizes, dimensions and materials of construction of the pyrolysis system can be selected for the operating conditions desired.

What is claimed is:

1. Pyrolysis system for reclamation and recovery of used battery constituents from non-lead acid batteries by pyrolysis comprising:

(a) a pyrolysis chamber including:

i. a central heating zone, maintained at sub-atmospheric pressure, ii. an entry zone for intermittently equalizing the pressure therein with the sub-atmospheric pressure in the central heating zone, iii. an exit zone for intermittently equalizing the pressure therein with the sub-atmospheric pressure in the central heating zone, iv. a rail system including a spaced-apart pair of parallel rails having an inclined segment, a horizontal segment, and a declined segment, the inclined segment being outside the entry zone, the horizontal segment being throughout the pyrolysis chamber and the declined segment being outside the exit zone, (b) a furnace for heating the central heating zone in a temperature range for pyrolysis of the non-lead acid batteries into vaporized constituents and residual solid constituents;

(c) a vapor recovery system including a vacuum source for providing a sub-atmospheric pressure in the heating zone and a sub-atmospheric pressure intermittently in the entry zone and exit zone, and apparatus for recovering the vaporized constituents volatilized during pyrolysis;

(d) a series of rail carts supported on the spaced-apart pair of rails for holding batteries entering the heating zone and the residual solid constituents remaining after pyrolysis;

(e) a delivery system including the inclined segment of the spaced-apart pair of rails and a cart release mechanism for transferring a rail cart containing the batteries for reclamation on the inclined segment into the entry zone by gravitation whenever the pressure in the entry zone is not equalized with the pressure in the heating zone;

(f) a transfer system for moving the series of rail carts sequentially from the entry zone into the heating zone whenever the pressure in the entry zone is equalized with the pressure in the heating zone until the heating zone is at rail cart capacity, and then into the exit zone whenever the pressure in the exit zone is equalized with the pressure in the heating zone and out of the exit zone onto the declined segment of the spaced-apart pair of rails whenever the pressure in the exit zone is not equalized with the pressure in the heating zone.

2. The pyrolysis system of claim 1 wherein the entry zone has an outer entry gate assembly and an inner entry gate assembly, and the exit zone has an inner exit gate assembly and an outer exit gate assembly.

3. The pyrolysis system of claim 2 wherein each gate assembly comprise:

(a) a pair of spaced-apart side members, each side member having a passageway therethrough, one of said side members having a first series of wedge blocks surrounding the passageway and the other of said side members having a sealing member surrounding the passageway;

(b) a spacing frame intermediate said pair of spaced-apart side members to form a chamber;

(c) a gate having a second series of wedge blocks for correlative engagement with the first series of wedge blocks of the one of said side members, the gate including an operating arm extending through the frame member and sealed thereto for reciprocally extending the gate within the chamber such that the first series of wedge blocks around the passageway of the one of said side panels engage the second series of wedge blocks of the gate and translate the gate into engagement with the sealing member to seal the passageway of the other of said side members having the sealing member and retracting the gate.

4. The pyrolysis system of claim 1 wherein the rail system includes a pair of spaced-apart rails and the pair of spaced-apart rails supports the series of rail carts.

5. A method for reclamation and recovery of used battery constituents from non-lead acid batteries by pyrolysis comprising:

(a) providing a pyrolysis chamber with a central heating zone, an entry zone and an exit zone;

(b) installing a rail system including a spaced-apart pair of rails extending throughout the pyrolysis chamber with an inclined segment outside the entry zone and a declined segment outside the exit zone;

(c) heating the central heating zone to a temperature range for pyrolysis to occur of the non-lead acid batteries;

(d) transferring a series of rail carts containing batteries for pyrolysis by the rail system at atmospheric pressure into the entry zone, one rail cart at a time;

(e) providing vapor recovery apparatus for maintaining a sub-atmospheric pressure in the heating zone and recovery of battery constituents volatilized by pyrolysis;

(f) decreasing intermittently the pressure in the entry zone to the sub-atmospheric pressure in the heating zone;

(g) transferring the series of rail carts under sub-atmospheric pressure from the entry zone into the heating zone for pyrolysis, one rail cart at a time, until the heating zone is at rail cart capacity, thereafter the series of rail carts extending throughout the entry zone, and the heating zone of the pyrolysis chamber;

(h) decreasing intermittently the pressure in the exit zone, concurrently with decreasing the pressure in the entry zone to the sub-atmospheric pressure in the heating zone;

(i) transferring the series of rail carts at the sub-atmospheric pressure out of the heating zone into the exit zone, one rail cart at a time;

(j) increasing intermittently the pressure in the exit zone concurrently with increasing the pressure in the entry zone to the atmospheric pressure;

(k) removing at atmospheric pressure the series of rail carts entering the exit zone, one rail cart at a time; and (l) recovering the residual battery constituents remaining in the cart.

6. The method of claim 5 wherein one rail cart, of the series of rail carts, is transferred into the exit zone from the heating zone while one rail cart, of the series of rail carts, is transferred into the heating zone from the entry zone while maintaining the entry zone and exit zone at the same sub-atmospheric pressure as the heating zone, and then, allowing the pressure in the entry zone and exit zone to reach atmospheric pressure, and thereafter transferring a rail cart into the entry zone and a rail cart out of the exit zone.

7. The method of claim 5 wherein the heating zone is maintained within a temperature range of 600° to 800° F.

8. The method of claim 5 wherein each rail cart of the series of rail carts remains in the heating zone for 2½ to 3½ hours.

9. The method of claim 5 wherein the sub-atmospheric pressure is equivalent to a partial vacuum of less than 1" of mercury.

10. A gate assembly for sealing a passageway into a reaction chamber comprising:

(a) a pair of spaced-apart panels transverse to the passageway into the reaction chamber, each panel having an opening therethrough, one of said panels having a first series of wedge blocks surrounding its opening, the other of said panels having a sealing member surrounding its opening;

(b) an open spacing frame intermediate said pair of spaced-apart panels to form a chamber;

(c) a gate having a second series of wedge blocks for correlative engagement with the first series of wedge blocks on one of said panels, the gate including an operating arm extending through the frame member for moving the gate such that the wedge blocks on one of said panels engage the wedge blocks of the gate and then moves the gate into engagement with the sealing member surrounding the opening of the other of said panels thereby sealing the passageway.

* * * * *